US009528669B2

(12) United States Patent
Liao

(10) Patent No.: US 9,528,669 B2
(45) Date of Patent: Dec. 27, 2016

(54) ROTATABLE LAMP HOLDER AND A SOLAR LAMP HAVING THE ROTATABLE LAMP HOLDER

(71) Applicant: Baozhang Liao, Hunan Province (CN)

(72) Inventor: Baozhang Liao, Hunan Province (CN)

( * ) Notice: Subject to any disclaimer, the term of this patent is extended or adjusted under 35 U.S.C. 154(b) by 38 days.

(21) Appl. No.: 14/754,671

(22) Filed: Jun. 29, 2015

(65) Prior Publication Data

US 2016/0053975 A1 Feb. 25, 2016

(30) Foreign Application Priority Data

Aug. 19, 2014 (CN) ..... 2014 2 0468619 U

(51) Int. Cl.

| | |
|---|---|
| ***F21V 21/30*** | (2006.01) |
| ***F21S 9/03*** | (2006.01) |
| ***F21S 10/06*** | (2006.01) |
| *F21S 6/00* | (2006.01) |
| *F21W 121/00* | (2006.01) |

(52) U.S. Cl.

CPC ..... *F21S 9/037* (2013.01); *F21S 10/06* (2013.01); *F21S 6/00* (2013.01); *F21W 2121/00* (2013.01)

(58) Field of Classification Search

CPC ..... F21V 21/30; F21V 23/006

See application file for complete search history.

(56) References Cited

U.S. PATENT DOCUMENTS

2002/0126472 A1* 9/2002 Smith ..... B60Q 1/2611 362/35

2009/0244911 A1* 10/2009 Schapira ..... H01R 33/0809 362/382

2012/0309209 A1* 12/2012 Zhou ..... H01R 39/64 439/21

* cited by examiner

*Primary Examiner* — Elmito Breval

(57) ABSTRACT

A rotatable lamp holder which comprises lighting elements, a power supply and a motor; the motor has a rotational output shaft; the lighting elements are disposed at a distal end of the rotational output shaft; the rotational output shaft is sleeved with a first PCB and a second PCB; the first PCB is connected to the power supply; the second PCB is connected to the lighting elements; the second PCB is rotatable with the rotational output shaft synchronously in the same direction; the first PCB is arranged with a positive pole coil and a negative pole coil; the second PCB is arranged with a positive pole conductive contact piece which contacts with the positive pole coil and a negative pole conductive contact piece which contacts with the negative pole coil. A solar lamp having the rotatable lamp holder is also provided.

19 Claims, 4 Drawing Sheets

ROTATABLE LAMP HOLDER AND A SOLAR LAMP HAVING THE ROTATABLE LAMP HOLDER

BACKGROUND OF THE INVENTION

The present invention belongs to the technical field of lighting devices, and more specifically relates to a rotatable lamp holder and a solar lamp having the rotatable lamp holder.

Nowadays, there are various kinds and designs of lamps. Most of these lamps are fixed and non-movable but a few of them may rotate dynamically such as the lamp disclosed by Chinese patent publication number CN2118233 U. The lamp disclosed by this Chinese patent enables the lamp shade to rotate automatically by reactional force created by a flow of air discharging upwardly through the fan-shaped flow diversion openings provided on the top part of the lamp shade. A few other kinds of rotatable lamps may rotate the light bulbs and the lamp components together but they are only suitable to serve some particular purposes where in many cases they serve the purposes of light condensation and light shifting. The lack of graphic and textual information on the peripheral surfaces of the lamp causes the lack of spectacularity of the lamp. Even if rich information is presented, the information is presented in a fixed and non-movable manner and thus it is visually tiring to watch.

A rotatable lamp now available in the market usually has a non-rotatable lighting element such as a light bulb powered by electricity to illuminate, and a rotatable lamp shade or lamp outer shell surrounding the lighting element and rotating under the driving force of a driving device. If the lamp shade or lamp outer shell does not rotate, the lighting element such as a light bulb connecting with a wire will easily cause the wire to tangle during rotation until rotation fails. The existing prior arts have not provided any solutions to the above technical problems.

BRIEF SUMMARY OF THE INVENTION

In view of the aforesaid disadvantages now present in the prior arts, the present invention provides a kind of rotatable lamp holder. During rotation of the lamp holder, lighting elements provided on the lamp holder will also rotate synchronously and in the same direction. Further, the wires connecting to the lighting elements will not tangle on the lamp holder due to rotation.

In overcome the technical problems of the prior arts, the present invention adopts the following technical proposal:

A rotatable lamp holder comprising lighting elements, wires, a power supply and a motor connected to the power supply. The motor comprises a rotational output shaft extending outwardly. The lighting elements are provided at a distal end of the rotational output shaft distal from the motor. A middle portion of the rotational output shaft is being sleeved with a first printed circuit board (PCB) and a second PCB juxtaposed with each other. The first PCB is positioned between the second PCB and the motor. The first PCB is connected to the power supply via the wires, and the second PCB is connected to the lighting elements via the wires. The first PCB is provided with a first axial hole for the support of the rotational output shaft and for the rotational output shaft to pass through. A side surface of the first PCB facing the second PCB is provided with a positive pole coil and a negative pole coil. The positive pole coil and the negative pole coil are concentrically arranged having the first axial hole being the common center of circle. The second PCB is provided with a second axial hole for fixing the rotational output shaft and for the rotational output shaft to pass through. The second PCB rotates synchronously in the same direction with the rotational output shaft via the second axial hole. A side surface of the second PCB facing the first PCB is provided with a positive pole conductive contact piece and a negative pole conductive contact piece. The positive pole conductive contact piece contacts with the positive pole coil. The negative pole conductive contact piece contacts with the negative pole coil.

In accordance with the above technical solution, the motor is connected to the power supply, therefore the on/off of the motor and thus the rotation or non-rotation of the rotational output shaft provided on the motor are controlled by the on/off of the power supply. Since the lighting elements are connected to the second PCB, and the second PCB is connected to the first PCB via the positive pole conductive contact piece and the negative pole conductive contact piece, and the first PCB is connected to the power supply via the wires, a complete light circuit is formed wherein the lighting elements are controlled to be switched on or off according to the on/off of the power supply. During rotation of the rotational output shaft, since the first PCB is fixed on the motor and will not rotate along with the rotational output shaft while the second PCB will rotate synchronously with the rotational output shaft in the same direction, the rotatable lamp holder will not cause the wires to tangle on the rotational output shaft during rotation and will not cause power failure as well. Since the lighting elements are provided on the rotational output shaft, rotation of the rotational output shaft will also drive the lighting elements to rotate synchronously with the rotational output shaft in the same direction, including rotation on a horizontal plane or vertical plane on which the light elements are disposed.

Preferably, the rotational output shaft is horizontally positioned, meaning that an elongated shaft of the rotational output shaft extends along a plane which is parallel to a horizontal plane. The lighting elements are provided at a rear end of the elongated shaft of the rotational output shaft which is horizontally positioned so that the lighting elements rotate synchronously with the rotational output shaft in the same direction on a vertical plane on which the lighting elements are disposed, thereby resulting in upward and downward dynamic movement of the lighting elements along the vertical plane and thus creating spectacular visual effect.

Preferably, the rotational output shaft is vertically positioned, meaning that an elongated shaft of the rotational output shaft extends along a plane which is perpendicular to a horizontal plane. The lighting elements are provided at a rear end of the elongated shaft of the rotational output shaft which is vertically positioned so that the lighting elements rotate synchronously with the rotational output shaft in the same direction on a horizontal plane on which the lighting elements are disposed, thereby resulting in a 360 degree rotation of the lighting elements along the horizontal plane and thus creating spectacular visual effect.

Preferably, the positive pole conductive contact piece and the negative pole conductive contact piece are made of phosphor copper. Phosphor copper is a kind of copper alloy having good electrical conductivity. Also, this kind of material will not be heated up easily, so it is strongly resistant to metal fatigue and it can at the same time ensure safety. Plug-in reeds made of phosphor copper are used in the present invention. The reeds being used are hard-wired to electronics. Connection without rivet or contact without friction can ensure good contact and resilience of the reeds and ensure stable plug-in of the reeds. Accordingly, positive pole connection and negative pole connection can always be ensured between the first PCB and the second PCB during rotation of the lamp holder, thereby continuously maintaining an intact circuit free from power failure and short circuit.

Preferably, the lighting elements are plural in terms of their quantity. The lighting elements are mutually connected with one another by parallel circuit or series circuit. The lighting elements are provided in intervals along the elongated shaft of the rotational output shaft to increase brightness and to increase the dynamic effect of the dynamic movement of the lighting elements along a horizontal or a vertical plane so as to create a more spectacular and dynamic visual effect.

Preferably, the positive pole coil on the first PCB comprises a first positive pole coil and a second positive pole coil concentrically arranged. The negative pole coil on the first PCB comprises a first negative pole coil and a second negative pole coil concentrically arranged. The positive pole conductive contact piece on the second PCB comprises a first positive pole conductive contact piece which contacts with the first positive pole coil and a second positive pole conductive contact piece which contacts with the second positive pole coil. The negative pole conductive contact piece on the second PCB comprises a first negative pole conductive contact piece which contacts with the first negative pole coil and a second negative pole conductive contact piece which contacts with the second negative pole coil. The lighting elements are plural in terms of quantity. Some of the lighting elements are connected with the first positive pole conductive contact piece, the first positive pole coil, the first negative pole conductive contact piece and the first negative pole coil via the wires constituting a first independent circuit. The remaining lighting elements are connected with the second positive pole conductive contact piece, the second positive pole coil, the second negative pole conductive contact piece and the second negative pole coil via the wires constituting a second independent circuit. The above configuration can allow control of the lighting elements provided on the rotatable lamp holder by the first independent circuit and the second independent circuit respectively. If the first independent circuit and the second independent circuit are switched on simultaneously, the light will be brighter and more condensed. The light will be dimmer if only the first independent circuit or the second independent circuit is switched on.

Preferably, a first switch is provided between the power supply and the first independent circuit for controlling on/off of the first independent circuit independently; a second switch is provided between the power supply and the second independent circuit for controlling on/off of the second independent circuit independently. Accordingly, different groups of lighting elements can be controlled independently. All lighting elements can be simultaneously switched on or switched off; alternatively, only some lighting elements can be switched on or switched off. Lighting elements can therefore be selectively switched on or off according to the ambient light and user's need.

Preferably, a control switch is provided on a positive pole output end of the power supply to simultaneously control on/off of the motor and the lighting elements, so that on/off of the motor and the lighting elements can be controlled by the control switch, thereby bringing much convenience to the users. Also, the lighting elements are ensured to be lighted up and rotate simultaneously with the rotation of the rotational output shaft driven by the motor. The situation where the rotational output shaft rotates without the lighting elements being lighted up will be prevented. Accordingly, the present invention can create spectacular visual effect.

Preferably, connecting pieces are fixedly connected between the second axial hole and the rotational output shaft. The second PCB is fixedly connected to the rotational output shaft via the connecting pieces, thereby attaining synchronous rotation of the second PCB and the rotational output shaft in the same direction. An end of each of the connecting pieces is fixedly connected to the rotational output shaft while another end of each of the connecting pieces is fixedly connected to the second PCB on which the second axial hole is provided, thereby driving the second PCB to rotate synchronously with the rotation of the rotational output shaft via the connecting pieces.

Preferably, the second axial hole has a square cross section or a cross section in the shape of a circle having a toothed periphery. A position of the rotational output shaft corresponding to the second axial hole has a shape that matches with the second axial hole. Therefore, the second PCB and the rotational output shaft rotate synchronously in the same direction. Since the second axial hole and the engaging portion of the rotational output shaft where the rotational output shaft engages with the second axial hole are both in the same shape, the second PCB is therefore also driven to rotate.

The present invention also provides a solar lamp having the rotatable lamp holder according to which solar energy is transferred to electricity to rotate the rotatable lamp holder and to light up the lighting elements wherein the lighting elements will rotate synchronously in the same direction during rotation of the lamp holder. The wires connected to the lighting elements will not tangle on the lamp holder due to rotation. The solar lamp having the rotatable lamp holder comprises a lamp case, a solar panel provided on an outer upper surface of the lamp case, and the rotational lamp holder described above. The rotational lamp holder is provided inside the lamp case. The power supply is a rechargeable battery. The solar panel and the rechargeable battery are mutually connected with each other. According to the above configuration, the electricity supplied to the motor and the lighting elements is the electricity transformed by the solar panel and stored in the rechargeable battery after the solar panel receives solar energy. Accordingly, the solar lamp can store electricity in daytime and illuminate and rotate in nighttime.

| Reference signs: | |
|---|---|
| 1: power supply | 2: motor |
| 20: rotational output shaft | 3: lighting elements |
| 4: first PCB | 41: positive pole coil |
| 42: negative pole coil | 40: first axial hole |
| 5: second PCB | 50: second axial hole |
| 51: positive pole conductive contact piece | 52: negative pole conductive contact piece |
| 6: connecting pieces | 7: lamp case |
| 8: solar panel | 100: first switch |
| 200: second switch | 300: control switch |
| 411: first positive pole coil | 412: second positive pole coil |
| 421: first negative pole coil | 422: second negative pole coil |
| 511: first positive pole conductive contact piece | 512: second positive pole conductive contact piece |
| 521: first negative pole conductive contact piece | 522: second negative pole conductive contact piece |

DETAILED DESCRIPTION OF THE INVENTION

The present invention is described in detail below with reference to the drawings.

Figure 1:
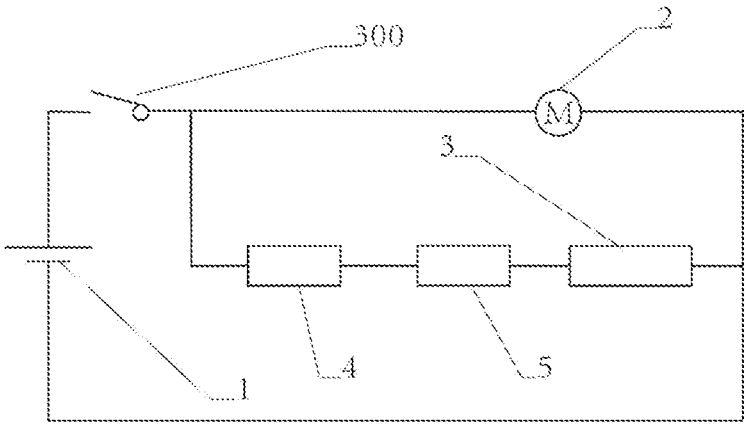
FIG. 1 is a circuit diagram of the rotatable lamp holder of the present invention.

A rotatable lamp holder which comprises lighting elements 3, wires, a power supply 1 and a motor 2 connected to the power supply 1. The motor 2 is provided with a rotational output shaft 20 extending outwardly. The lighting elements 3 are provided at a distal end of the rotational output shaft 20 distal from the motor 2. A middle portion of the rotational output shaft 20 is being sleeved with a first printed circuit board (PCB) 4 and a second PCB 5 juxtaposed with each other. The first PCB 4 is positioned between the second PCB 5 and the motor 2. The first PCB 4 is connected to the power supply 1 via the wires, and the second PCB 5 is connected to the lighting elements 3 via the wires. In the present invention, the second PCB 5 can be single sided board or a double sided board. A control switch 300 is provided on a positive pole output end of the power supply 1 to simultaneously control on/off of the motor 2 and the lighting elements 3, as shown in FIG. 1.

On the basis of the above disclosure, the present invention has the following preferred embodiments:

Embodiment 1

Figure 3:
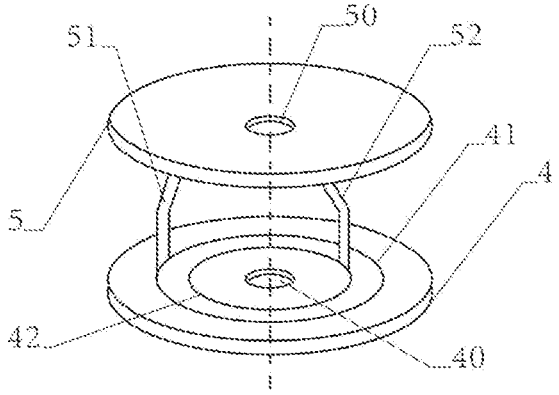
FIG. 3 shows the structural connection between the first PCB and the second PCB according to the present invention.
Figure 5:
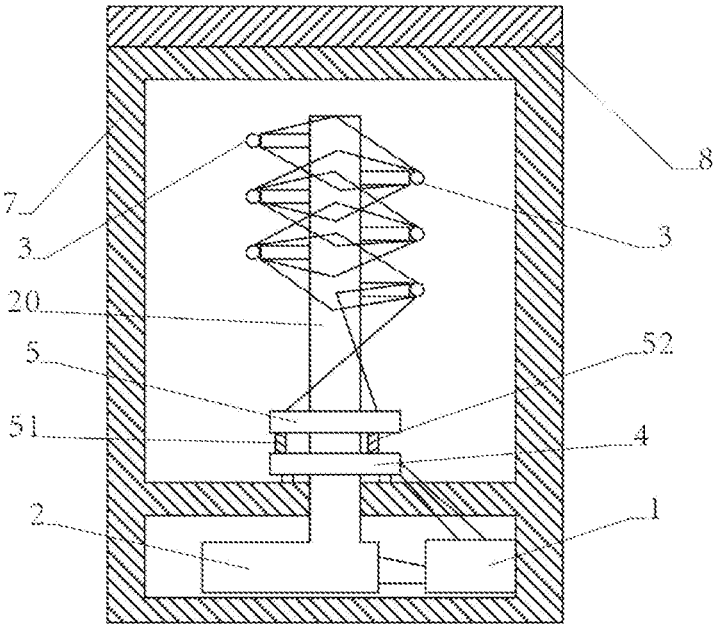
FIG. 5 is a structural diagram showing the rotational output shaft being vertically positioned.

As shown in FIG. 3 and FIG. 5, the lighting elements 3 are plural in terms of their quantity. Plurality of the lighting elements 3 may be connected with one another via parallel circuit or series circuit. Lighting elements 3 connected by parallel circuit will not affect one another. Even if one of the lighting elements 3 is damaged, it will not affect the normal operation of the other lighting elements 3.

In the present embodiment, the first PCB 4 is provided with a first axial hole 40 for the support of the rotational output shaft 20 and for the rotational output shaft 20 to pass through. A side surface of the first PCB 4 facing the second PCB 5 is provided with a positive pole coil 41 and a negative pole coil 42. The positive pole coil 41 and the negative pole coil 42 are concentrically arranged having the first axial hole 40 being the common center of circle. Preferably, the positive pole coil 41 has a radius greater than the radius of the negative pole coil 42, as shown in FIG. 3. Alternatively, the radius of the positive pole coil 41 may be smaller than the radius of the negative pole coil 42.

A side surface of the second PCB 5 facing the first PCB 4 is provided with a positive pole conductive contact piece 51 and a negative pole conductive contact piece 52. The positive pole conductive contact piece 51 contacts with the positive pole coil 41. The negative pole conductive contact piece 52 contacts with the negative pole coil 42. The positive pole conductive contact piece 51 and the negative pole conductive contact piece 52 are made of phosphor copper.

Figure 4:
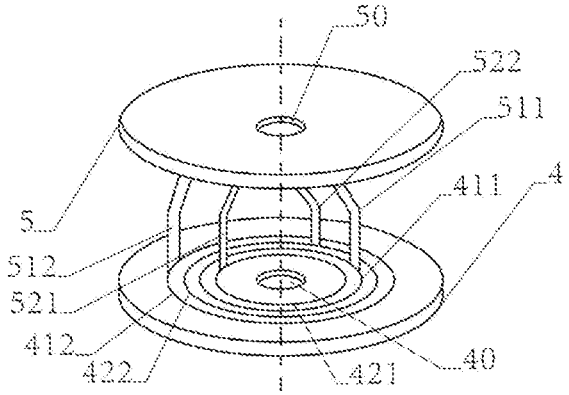
FIG. 4 shows the structural connection between the first PCB and the second PCB according to the third embodiment of the present invention.

In the present embodiment, the rotational output shaft 20 is vertically positioned, as shown in FIG. 4. The second PCB 5 is provided with a second axial hole 50 for fixing the rotational output shaft 20 and for the rotational output shaft 20 to pass through. The second PCB 5 rotates synchronously in the same direction with the rotational output shaft 20 via the second axial hole 50.

Figure 7:
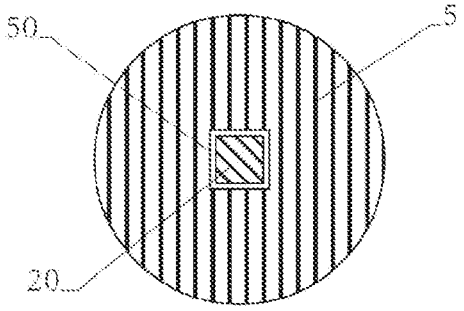
FIG. 7 is a preferred structural connection between the second PCB and the rotational output shaft.
Figure 8:
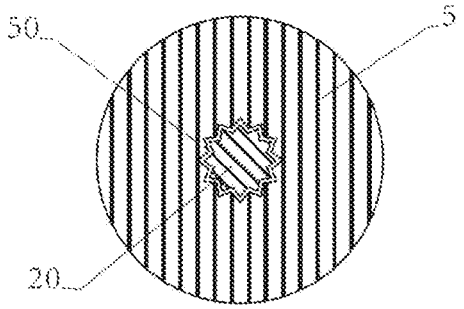
FIG. 8 is another preferred structural connection between the second PCB and the rotational output shaft.

Synchronous rotation of the second PCB 5 and the rotational output shaft 20 in the same direction may be attained by the following preferred structural configuration: The second axial hole 50 has a square cross section as shown in FIG. 7, and a position of the rotational output shaft 20 corresponding to the second axial hole 50 has a shape that matches with the second axial hole 50. As such, the second PCB 5 and the rotational output shaft 20 rotate synchronously in the same direction. In the above structural configuration, the second axial hole 50 may also have a cross section in the shape of a circle having a toothed periphery as shown in FIG. 8.

Figure 9:
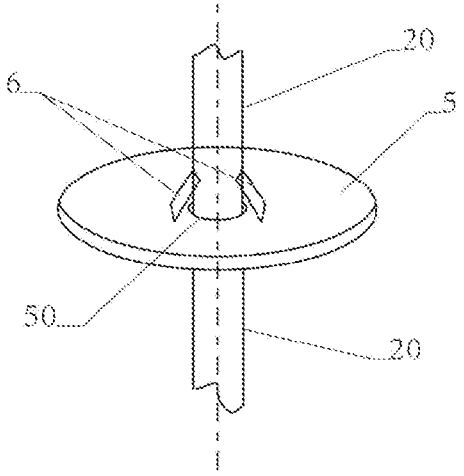
FIG. 9 is a preferred structural connection between the second PCB and the rotational output shaft according to which connecting pieces are provided between the second PCB and the rotational output shaft.

Alternatively, synchronous rotation of the second PCB 5 and the rotational output shaft 20 in the same direction may be attained by another preferred structural configuration: As shown in FIG. 9, connecting pieces 6 are fixedly connected between the second axial hole 50 and the rotational output shaft 20 so that the second PCB 5 is fixedly connected to the rotational output shaft 20 via the connecting pieces 6, thereby attaining synchronous rotation of the second PCB 5 and the rotational output shaft 20 in the same direction.

The present embodiment also provides a solar lamp having the rotatable lamp holder. The solar lamp comprises a lamp case 7, a solar panel 8 provided on an outer upper surface of the lamp case 7, and the rotational lamp holder described in embodiment 1. The rotational lamp holder is provided inside the lamp case 7. The power supply 1 is a rechargeable battery. The solar panel 8 and the rechargeable battery are mutually connected with each other as shown in FIG. 5.

Embodiment 2

Figure 6:
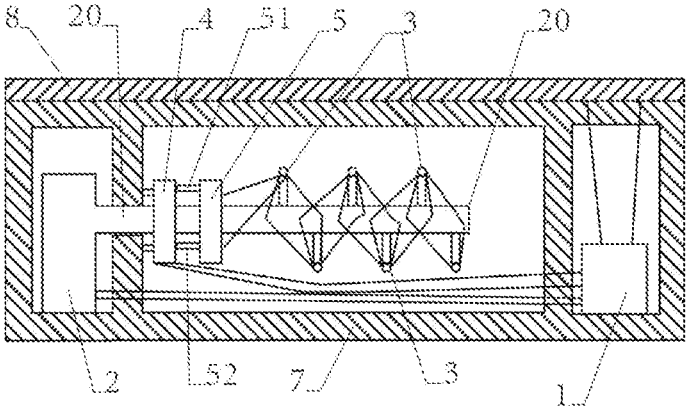
FIG. 6 is a structural diagram showing the rotational output shaft being horizontally positioned.

A rotatable lamp holder is provided in embodiment 2. The rotatable lamp holder provided in this embodiment is different from the rotatable lamp holder in embodiment 1 only in that the rotational output shaft 20 in embodiment 2 is positioned horizontally as shown in FIG. 6. The first PCB, the second PCB and the lighting elements in this embodiment have the same structures and the same connections as those disclosed in embodiment 1, so they will not be repeatedly described herein.

A solar lamp having the rotatable lamp holder is also provided in embodiment 2. The solar lamp comprises a lamp case 7, a solar panel 8 provided on an outer upper surface of the lamp case 7, and the rotatable lamp holder described in embodiment 1. The rotatable lamp holder is provided inside the lamp case 7. The power supply 1 is a rechargeable battery. The solar panel 8 and the rechargeable battery are mutually connected with each other.

Embodiment 3

As shown in FIG. 4, a rotatable lamp holder is provided in embodiment 3. In embodiment 3, the first PCB 4 is provided with the positive pole coil 41 and the negative pole coil 42 thereon. The positive pole coil 41 comprises a first positive pole coil 411 and a second positive pole coil 412 concentrically arranged. The negative pole coil 42 comprises a first negative pole coil 421 and a second negative pole coil 422 concentrically arranged. The second PCB 5 is provided with the positive pole conductive contact piece 51 and the negative pole conductive contact piece 52. The positive pole conductive contact piece 51 comprises a first positive pole conductive contact piece 511 which contacts with the first positive pole coil 411 and a second positive pole conductive contact piece 512 which contacts with the second positive pole coil 412. The negative pole conductive contact piece 52 comprises a first negative pole conductive contact piece 521 which contacts with the first negative pole coil 421 and a second negative pole conductive contact piece 522 which contacts with the second negative pole coil 422. The lighting elements 3 are plural in terms of quantity. Some of the lighting elements 3 are connected with the first positive pole conductive contact piece 511, the first positive pole coil 411, the first negative pole conductive contact piece 521 and the first negative pole coil 421 via the wires constituting a first independent circuit. The remaining lighting elements 3 are connected with the second positive pole conductive contact piece 512, the second positive pole coil 412, the second negative pole conductive contact piece 522 and the second negative pole coil 422 via the wires constituting a second independent circuit. The first positive pole conductive contact piece 511, the second positive pole conductive contact piece 512, the first negative pole conductive contact piece 521 and the second negative pole conductive contact piece 522 are all made of phosphor copper.

Figure 2:
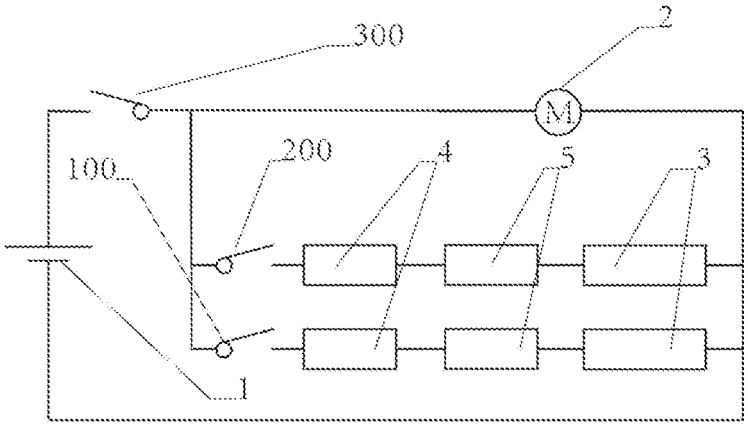
FIG. 2 is a circuit diagram of the rotatable lamp holder according to the third embodiment of the present invention.

In embodiment 3 and as shown in FIG. 2, a first switch 100 is provided between the power supply 1 and the first independent circuit for controlling on/off of the first independent circuit independently; a second switch 200 is provided between the power supply 1 and the second independent circuit for controlling on/off of the second independent circuit independently. Accordingly, the different groups of lighting elements 3 can be controlled independently. All lighting elements 3 can be simultaneously switched on or switched off; alternatively, only some lighting elements can be switched on or switched off. Lighting elements can therefore be selectively switched on or off according to the ambient light and user's need.

In embodiment 3, the rotational output shaft 20 is vertically positioned. The first PCB 4 is provided with a first axial hole 40 for the support of the rotational output shaft 20 and for the rotational output shaft 20 to pass through. The second PCB 5 is provided with a second axial hole 50 for fixing the rotational output shaft 20 and for the rotational output shaft 20 to pass through. The second PCB 5 rotates synchronously in the same direction with the rotational output shaft 20 via the second axial hole 50.

Synchronous rotation of the second PCB 5 and the rotational output shaft 20 in the same direction may be attained by the following preferred structural configuration: The second axial hole 50 has a square cross section as shown in FIG. 7, and a position of the rotational output shaft 20 corresponding to the second axial hole 50 has a shape that matches with the second axial hole 50. As such, the second PCB 5 and the rotational output shaft 20 rotate synchronously in the same direction. In the above structural configuration, the second axial hole 50 may also have a cross section in the shape of a circle having a toothed periphery as shown in FIG. 8.

Alternatively, synchronous rotation of the second PCB 5 and the rotational output shaft 20 in the same direction may be attained by another preferred structural configuration: As shown in FIG. 9, connecting pieces 6 are fixedly connected between the second axial hole 50 and the rotational output shaft 20 so that the second PCB 5 is fixedly connected to the rotational output shaft 20 via the connecting pieces 6, thereby attaining synchronous rotation of the second PCB 5 and the rotational output shaft 20 in the same direction.

The present embodiment also provides a solar lamp having the rotatable lamp holder. The solar lamp comprises a lamp case 7, a solar panel 8 provided on an outer upper surface of the lamp case 7, and the rotational lamp holder described in embodiment 1. The rotational lamp holder is provided inside the lamp case 7. The power supply 1 is a rechargeable battery. The solar panel 8 and the rechargeable battery are mutually connected with each other as shown in FIG. 5.

The present invention should not be limited to the preferred embodiments disclosed herein. Any equivalent or similar technical solutions resulted from the structural changes of the present invention based on the disclosure of the present invention should also fall within the scope of protection of the present invention.

What is claimed is:

1. A rotatable lamp holder comprising lighting elements (3), wires, a power supply (1) and a motor (2) connected to the power supply (1); the motor (2) comprising a rotational output shaft (20) extending outwardly; the lighting elements (3) being provided at a distal end of the rotational output shaft (20) distal from the motor (2); wherein a middle portion of the rotational output shaft (20) is being sleeved with a first printed circuit board (PCB) (4) and a second PCB (5) juxtaposed with each other; the first PCB (4) is positioned between the second PCB (5) and the motor (2); the first PCB (4) is connected to the power supply (1) via the wires, and the second PCB (5) is connected to the lighting elements (3) via the wires; the first PCB (4) is provided with a first axial hole (40) for support of the rotational output shaft (20) and for the rotational output shaft (20) to pass through; a side surface of the first PCB (4) facing the second PCB (5) is provided with a positive pole coil (41) and a negative pole coil (42); the positive pole coil (41) and the negative pole coil (42) are concentrically arranged having the first axial hole (40) being a common center of circle; the second PCB (5) is provided with a second axial hole (50) for fixing the rotational output shaft (20) and for the rotational output shaft to pass through (20); the second PCB (5) is rotatable synchronously in the same direction with the rotational output shaft (20) via the second axial hole (50); a side surface of the second PCB (5) facing the first PCB (4) is provided with a positive pole conductive contact piece (51) and a negative pole conductive contact piece (52); the positive pole conductive contact piece (51) contacts with the positive pole coil (41); the negative pole conductive contact piece (52) contacts with the negative pole coil (42).

2. The rotatable lamp holder as in claim 1, wherein the rotational output shaft (20) is horizontally positioned or the rotational output shaft (20) is vertically positioned; or the lighting elements (3) are plural in terms of quantity; the lighting elements (3) are mutually connected with one another by a parallel circuit or a series circuit.

3. The rotatable lamp holder as in claim 1, wherein the positive pole coil (41) comprises a first positive pole coil (411) and a second positive pole coil (412) concentrically arranged; the negative pole coil (42) comprises a first negative pole coil (421) and a second negative pole coil (422) concentrically arranged; the positive pole conductive contact piece (51) comprises a first positive pole conductive contact piece (511) which contacts with the first positive pole coil (411) and a second positive pole conductive contact piece (512) which contacts with the second positive pole coil (412); the negative pole conductive contact piece (52) comprises a first negative pole conductive contact piece (521) which contacts with the first negative pole coil (421) and a second negative pole conductive contact piece (522) which contacts with the second negative pole coil (422); the lighting elements (3) are plural in terms of quantity; some of the lighting elements (3) are connected with the first positive pole conductive contact piece (511), the first positive pole coil (411), the first negative pole conductive contact piece (521) and the first negative pole coil (421) via the wires constituting a first independent circuit; the remaining lighting elements (3) are connected with the second positive pole conductive contact piece (512), the second positive pole coil (412), the second negative pole conductive contact piece (522) and the second negative pole coil (422) via the wires constituting a second independent circuit.

4. The rotatable lamp holder as in claim 3, wherein a first switch (100) is provided between the power supply (1) and the first independent circuit for controlling on/off of the first independent circuit independently; a second switch (200) is provided between the power supply (1) and the second independent circuit for controlling on/off of the second independent circuit independently.

5. The rotatable lamp holder as in claim 1, wherein a control switch (300) is provided on a positive pole output end of the power supply (1) to simultaneously control on/off of the motor (2) and the lighting elements (3).

6. The rotatable lamp holder as in claim 1, wherein connecting pieces (6) are fixedly connected between the second axial hole (50) and the rotational output shaft (20); the second PCB (5) is fixedly connected to the rotational output shaft (20) via the connecting pieces (6) and is rotatable together with the rotational output shaft (20) synchronously in the same direction.

7. The rotatable lamp holder as in claim 1, wherein the second axial hole (50) has a square cross section or a cross section in a shape of a circle having a toothed periphery; a position of the rotational output shaft (20) corresponding to the second axial hole (50) has a shape that matches with the second axial hole (50); the second PCB (5) is rotatable together with the rotational output shaft (20) synchronously in the same direction.

8. A rotatable lamp holder, wherein the rotatable lamp holder comprises a first printed circuit board (PCB) (4) and a second PCB (5) juxtaposed with each other or oppositely arranged; the second PCB (5) is rotatable with respect to the first PCB (4); during rotation, the first PCB (4) and the second (PCB) are continuously connected with each other by corresponding electrical connections via a positive pole conductive contact piece (51) and a negative pole conductive contact piece (52).

9. The rotatable lamp holder as in claim 8, wherein the first PCB (4) is provided with a positive pole coil (41) and a negative pole coil (42); the positive pole conductive contact piece (51) contacts with the positive pole coil (41); the negative pole conductive contact piece (52) contacts with the negative pole coil (42).

10. The rotatable lamp holder as in claim 8, wherein the positive pole coil (41) and the negative pole coil (42) are concentrically arranged having a rotational axis of the second PCB (5) being the common center of circle.

11. The rotatable lamp holder as in claim 8, wherein the rotatable lamp holder comprises lighting elements (3) and a motor (2); the lighting elements (3) are disposed on a rotational output shaft (20) of the motor (2); the rotational output shaft (20) is being sleeved with the first PCB (4) and the second PCB (5) juxtaposed with each other; the first PCB (4) is electrically connected to a power supply (1); the second PCB (5) is electrically connected to the lighting elements (3); the first PCB (4) is provided with a first axial hole (40) for the rotational output shaft (20) to pass through; the first PCB (4) is provided with a positive pole coil (41) and a negative pole coil (42); the second PCB (5) is rotatable together with the rotational output shaft (20); the second PCB (5) is provided with the positive pole conductive contact piece (51) and the negative pole conductive contact piece (52); the positive pole conductive contact piece (51) contacts with the positive pole coil (41); the negative pole conductive contact piece (52) contacts with the negative pole coil (42).

12. The rotatable lamp holder as in claim 11, wherein the positive pole coil (41) and the negative pole coil (42) are concentrically arranged having the first axial hole (40) being the common center of circle.

13. The rotatable lamp holder as in claim 11, wherein the second PCB (5) is provided with a second axial hole (50) for fixing the rotational output shaft (20) and for the rotational output shaft (20) to pass through.

14. The rotatable lamp holder as in claim 11, wherein the second PCB (5) is rotatable together with the rotational output shaft (20) synchronously in the same direction.

15. The rotatable lamp holder as in claim 11, wherein the power supply (1) is electrically connected to the motor (2); the lighting elements (3) and the rotational output shaft (20) are fixedly connected; the first PCB (4) and the second PCB (5) sleeve onto a portion of the rotational output shaft (20) extending out of the motor (2); the first PCB (4) is positioned between the second PCB (5) and the motor (2); the first PCB (4) is connected to the power supply (1) via wires, and the second PCB (5) is connected to the lighting elements (3) via wires; the positive pole coil (41) and the negative pole coil (42) are arranged on a side surface of the first PCB (4) facing the second PCB (5); the second PCB (5) is provided with a second axial hole (50) for fixing the rotational output shaft (20) and for the rotational output shaft to pass through (20); the second PCB (5) is rotatable synchronously in the same direction with the rotational output shaft (20) via the second axial hole (50); the positive pole conductive contact piece (51) and the negative pole conductive contact piece (52) are arranged on a side surface of the second PCB (5) facing the first PCB (4); during rotation of the second PCB (5), the positive pole conductive contact piece (51) continuously contacts with the positive pole coil (41); during rotation of the second PCB (5), the negative pole conductive contact piece (52) continuously contacts with the negative pole coil (42).

16. The rotatable lamp holder as in claim 15, wherein the first PCB (4) and the second PCB (5) are arranged parallel to each other; the first axial hole (40) and the second axial hole (50) are co-axial.

17. The rotatable lamp holder as in claim 11, wherein the lighting elements (3) are provided at a distal end of the rotational output shaft (20) distal from the motor (2).

18. The rotatable lamp holder as in claim 11, wherein the first PCB (4) is fixedly connected to an outer shell of the motor (2).

19. A solar lamp comprising a lamp case (7) and a solar panel (8) provided on an outer upper surface of the lamp case (7), wherein the solar lamp also comprises the rotational lamp holder as in claim 1 or 8; the rotational lamp holder is provided inside the lamp case (7); the power supply (1) is a rechargeable battery; the solar panel (8) and the rechargeable battery are mutually connected with each other.

* * * * *